United States Patent [19]

Guzman

[11] Patent Number: 4,600,327

[45] Date of Patent: Jul. 15, 1986

[54] WRITING PEN WITH CORRECTION FLUID RESERVOIR

[76] Inventor: Joe O. Guzman, 5110 Academy, #4, Houston, Tex. 77005

[21] Appl. No.: 675,866

[22] Filed: Nov. 28, 1984

[51] Int. Cl.[4] ..... B43K 29/04

[52] U.S. Cl. ..... 401/18; 401/17; 401/34; 401/129

[58] Field of Search ..... 401/17, 18, 23, 129, 401/34, 21, 195

[56] References Cited

U.S. PATENT DOCUMENTS

| | | | |
|---|---|---|---|
| 1,143,629 | 6/1915 | Hughes | 401/18 X |
| 2,009,899 | 7/1935 | Nagl et al. | 401/129 |
| 2,046,022 | 6/1936 | Hughes | 401/18 X |
| 2,323,302 | 7/1943 | Block | 401/21 X |
| 2,354,402 | 7/1944 | Petruccione et al. | 401/195 X |
| 2,481,803 | 9/1949 | Weaver . | |
| 2,658,479 | 11/1953 | Fried | 401/195 |
| 3,341,884 | 9/1967 | Pryor . | |
| 3,733,139 | 5/1973 | Neidhardt et al. . | |
| 3,941,488 | 3/1976 | Maxwell . | |
| 4,156,657 | 5/1979 | Lin . | |
| 4,227,930 | 10/1980 | Lin . | |
| 4,406,555 | 9/1983 | Tsai | 401/17 X |

FOREIGN PATENT DOCUMENTS

| | | | |
|---|---|---|---|
| 362501 | 10/1922 | Fed. Rep. of Germany | 401/18 |
| 719725 | 2/1932 | France | 401/17 |
| 2494637 | 5/1982 | France | 401/34 |
| 142244 | 9/1953 | Sweden | 401/129 |
| 958 | of 1894 | United Kingdom | 401/17 |

*Primary Examiner*—Steven A. Bratlie
*Attorney, Agent, or Firm*—Neal J. Mosely

[57] ABSTRACT

A writing instrument has an ink applicator at one end and a hollow cylindrical reservoir at the opposed end containing a correction fluid. A first cap member is removably received on the instrument to cover the ink applicator when not in use and a second cap member is removably received on the opposed end of the instrument to enclose the reservoir. A fluid applicator brush is secured in the second cap and has a depending portion which is removably received within the reservoir in a stored position when the second cap is in place.

4 Claims, 5 Drawing Figures

WRITING PEN WITH CORRECTION FLUID RESERVOIR

BACKGROUND OF THE INVENTION

1. Field of the Invention

This invention relates to writing pens having ink eradicator or correction means and more particularly to a writing pen having a reservoir containing a correction fluid and removable brush applicator.

2. Brief Description of the Prior Art

Writing pens having ink eradicators and erasing means are known in the art. The listed patents are the best prior art known to the inventor:

Weaver, U.S. Pat. No. 2,481,803 discloses an applicator for ink eradicators wherein an eradicator fluid well is mounted in a fountain pen cap having a removable cover. A tube has one end extending into the well and its other end provided with a rubber sponge. In order to eradicate ink, the cover of the cap is removed and the pen is inverted allowing the eradicator fluid to flow through the tube and moisten the sponge. The sponge is then applied to the ink to be eradicated. This device also uses gravitational force to apply the eradicator fluid.

Maxwell, U.S. Pat. No. 3,941,488 discloses a marker having an erasing unit at the opposed end. The erasing unit comprises an enclosing barrel having a porous tip applicator and an inner wick of glass wool impregnated with a chemical reagent to bleach the dye or ink.

Neidhardt, U.S. Pat. No. 3,733,139 discloses a combination pen having a ball point cartridge at one end and a felt tip cartridge at the other.

Lin, U.S. Pat. Nos. 4,156,657 and 4,227,930 disclose a reversable pen having a compartment for ink and an opposed compartment for eradicator fluid. There is no brush applicator. These patents are directed toward the chemical composition of the eradicator fluid.

Prior, U.S. Pat. No. 3,341,884 discloses a holder having a nail polish receptable and a polish remover receptacle mounted at opposed ends. The polish receptacle has a hollow brush applicator which is screwed onto the open end of the receptacle to extend inwardly and covered with a cap in a stored position. To apply polish, the brush is unscrewed, inverted, and screwed onto the receptacle to extend outwardly. Gravitational force causes polish to flow through the hollow brush. The polish receptacle may also be compressed by a small handle to pneumatically force the polish through the brush.

The prior art in general, and these patents in particular, do not disclose a writing pen with a reservoir for a white-out type of correction fluid and a brush applicator.

SUMMARY OF THE INVENTION

It is therefore an object of the present invention to provide a compact writing pen having a correction fluid reservoir which may be conveniently carried in the pocket or purse of the user.

Another object of this invention is to provide a writing pen with a correction fluid reservoir wherein a cap member having a brush applicator depending therefrom is received on the end of the instrument to sealably enclose the reservoir and prevent leakage in a stored position and quickly and easily removed for use.

Another object of this invention is to provide a writing pen having a correction fluid reservoir which may be easily refilled or removed and replaced by another filled reservoir.

Another object of this invention is to provide a writing pen with a correction fluid reservoir wherein the brush applicator is carried within the reservoir in a stored position to maintain the brush moist and prevent stiffness.

A further object of this invention is to provide a writing pen having a correction fluid reservoir that is of simple, sturdy and inexpensive construction.

Other objects of the invention will become apparent from time to time throughout the specification and claims as hereinafter related.

The above noted objects and other objects of the invention are accomplished by a writing instrument having an ink applicator at one end and a hollow cylindrical portion at the opposed end which houses a correction fluid reservoir. A first cap member is removably received on the instrument to cover the ink applicator when not in use and a second cap member is removably received on the opposed end of the instrument to sealably enclose the reservoir. A fluid applicator brush is secured in the second cap and has a depending portion which is removably received within the reservoir in a stored position when the second cap is in place.

DESCRIPTION OF THE PREFERRED EMBODIMENT

Figure 1:
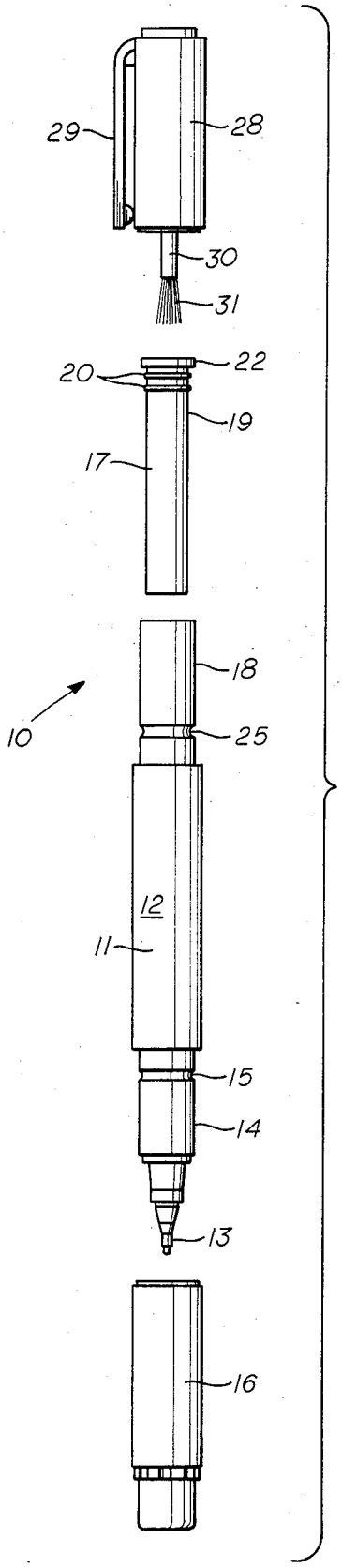
FIG. 1 is an exploded view of a preferred writing pen having a correction fluid reservoir showing the principal components of the present invention.

Referring now to the drawings by numerals of reference, there is shown a preferred writing pen 10 with a correction fluid reservoir. The writing pen 10 comprises a conventional ink pen body 11 having a main body or barrel portion 12 and an ink applicator tip 13 at its lower end, e.g. ball point, felt tip, porous plastic tip, quill tip, etc.

The lower end portion 14 of the ink pen barrel 13 is of reduced diameter and has an annular groove 15 for receiving a conventional mating annular snap bead (not shown) on the interior surface of the lower cap member 16. The lower cap 16 is slidably received on the reduced diameter lower portion 14 and removably retained thereon by the mating bead snapping into the groove 15. The cap 16 covers and protects the ink applicator tip 13 when not in use. The cap 16 is simply pulled from the lower portion 14 when the pen is to be used for writing.

A tubular correction fluid reservoir 17 with an open top and closed bottom end is removably received and carried within the hollow cylindrical upper portion 18 of the pen barrel 12. The reservoir 17 has an upper external surface 19 with a pair of vertically-spaced, small, circumferential bands or ribs 20 of sufficient diameter to provide a snug friction fit against the interior wall surface 21 of the upper portion 18. An end flange 22 of approximately the same outer diameter as that of the upper portion 18 is located at the top of the reservoir 17 and has a central opening 23. The reservoir 17 is pressed into the upper portion 18 until the flange 22 rests on the top surface of the upper portion.

Figure 3:
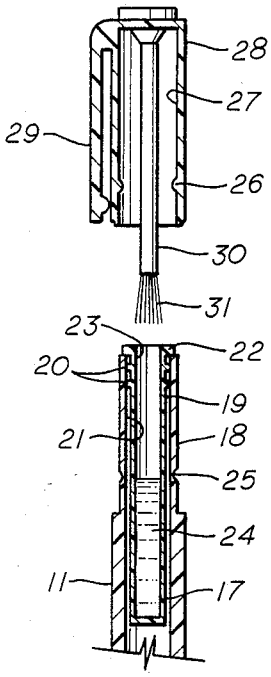
FIG. 3 is a view in cross section similar to FIG. 1 of the writing pen with the applicator cap removed in preparation for use.

The reservoir 17 is filled with a suitable ink correction fluid 24 (FIG. 3) which effectively reacts with the type of ink contained within the pen 11. An opaque correction fluid would be effective for a wide range of ink types, and is commercially available in various colors. It should be understood that ink eradicating fluid which eradicates the ink by a bleaching process may also be used in the reservoir.

The hollow, cylindrical, reduced-diameter, upper portion 18 of the ink pen barrel 12 has an annular groove 25 which receives a mating annular snap bead 26 disposed on the interior surface 27 of an applicator cap member 28. Conventionally, the applicator cap 28 is slidably received on the reduced diameter upper portion 18 and removably retained thereon by the mating bead 26 snapping into the groove 25 to enclose the reservoir 17. The cap 28 has a pocket clip 29 for convenient carrying in the pocket of the user.

Figure 2:
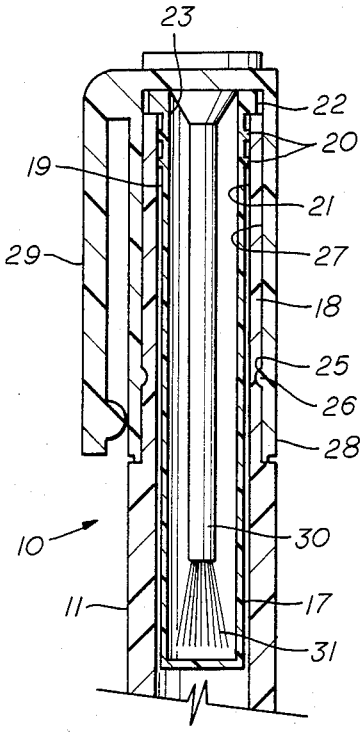
FIG. 2 is a detail view in longitudinal cross section of the upper portion of the writing pen with the applicator cap installed on the pen.

An applicator brush 30 is secured at its top end to the cap 28 to extend centrally downward below the bottom end of the cap to protrude therefrom. Bristles 31 are provided on the lower, protruding end of the brush 30. When the brush 30 is not being used, it is stored within the reservoir 17 with the cap 28 secured on the upper portion 18. The cap 28 forms a fluid tight seal against the flange 22 (FIG. 2). The brush bristles 31 are thus maintained in a moist condition ready for use.

Figure 4:
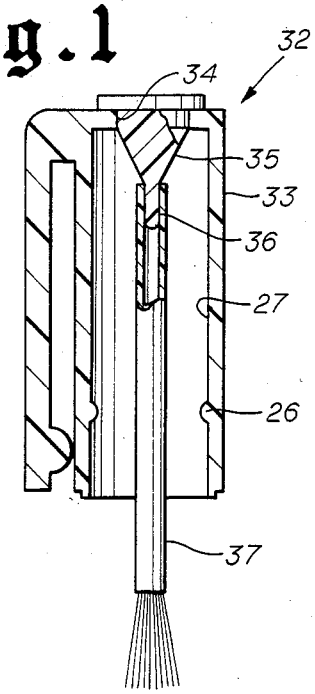
FIG. 4 is a detail sectional view of a modified applicator cap member in accordance with the present invention.

FIG. 4 shows an alternate cap and brush assembly 32. The cap 33 has a central opening 34 into which is secured a conically tapered plug 35. The plug 35 may be secured in the opening 34 by cementing or other suitable means or may have a press fit therein. The depending end of the tapered plug 35 has a small diameter 36 which is secured into the top of the hollow shaft of a brush 37 by cementing or other suitable means or by a press fit therein. It should be understood that the when the cap 33 is secured onto the upper portion of the barrel 18, the tapered sidewall of the plug 35 may also seal against the central opening of the flange 22 to provide an additinal fluid seal.

Figure 5:
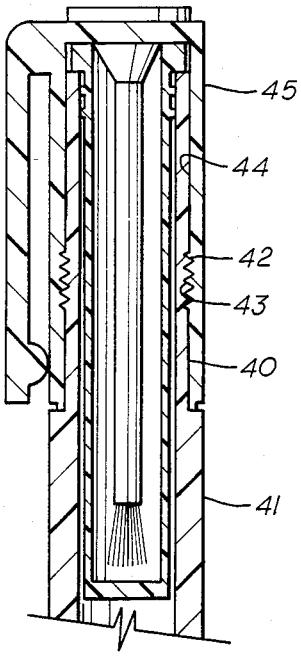
FIG. 5 shows an alternate means of connecting the applicator cap to the upper portion of the pen.

FIG. 5 shows an alternate means of connecting the applicator cap to the upper portion of the pen. The hollow, cylindrical, reduced-diameter, upper portion 40 of the ink pen barrel 41 has external threads 42 which receive mating internal threads 43 on the interior surface 44 of the applicator cap member 45. It should be understood that the cap connections depicted in FIGS. 1–4 may also be provided with threaded connections.

OPERATION

The writing pen 10 with the lower cap 16 and the applicator cap 28 secured on each appropriate end is normally carried in the pocket or purse of the user. When writing with the pen, the user simply removes the lower cap 16 and writes in the conventional manner. When it is desired to make a correction, the user removes the applicator cap 28 and holding it in the finger tips, applies the correction fluid over the inked area to be corrected. When the correction fluid is exhausted, the reservoir may be refilled from a bottle or removed from the barrel and replaced with a prefilled reservoir which may be supplied with the pen or purchased separately.

While this invention has been described fully and completely with special emphasis upon several embodiments, it should be understood that within the scope of the appended claims the invention may be practiced otherwise than as specifically described herein.

I claim:

1. A writing instrument with combined ink applicator and correction fluid reservoir comprising;

a writing instrument having an ink applicator at one end and a hollow cylindrical portion at the opposed end, a first closure member removably received on said instrument at said one end to enclose said ink applicator and comprising a cylindrical cap enclosed at one end and having an annular bead disposed on the interior surface, said writing instrument having a circumferentially disposed groove adapted to removably receive said annular bead, a tubular reservoir containing opaque correction fluid open at one end and removably received and carried within the hollow cylindrical portion at said opposed end of said instrument, said tubular reservoir comprises an elongated tubular portion open at one end adapted to be frictionally and slidably received within the hollow cylindrical portion of said instrument, a circumferential flange surrounding said open end and extending radially therefrom to rest on the top surface of the hollow cylindrical portion of said instrument, a second closure member removably received on said instrument at said opposed end to sealably enclose the open end of said reservoir and comprising a cylindrical cap enclosed at one end and having an annular bead disposed on the interior surface, said writing instrument having a circumferentially disposed groove adapted to removably receive said annular bead and simultaneously upon receipt therein said enclosed end sealably enclosing the open end of said reservoir, and a fluid applicator secured to and carried by said second closure member comprising a tubular brush stem having bristles at the inner end thereof removaly received within said reservoir in a stored position.

2. A writing instrument according to claim 1 in which said second closure member has an external clip fastener adapted to be received on the pocket of the user for carrying said writing instrument therein with said reservoir in an upright position to prevent accidental loss of fluid from said reservoir.

3. A writing instrument with combined ink applicator and correction fluid reservoir comprising:

a writing instrument having an ink applicator at one end and a hollow cylindrical portion at the opposed end, a first closure member removably received on said instrument at said one end to enclose said ink applicator and comprising a cylindrical cap enclosed at one end and having threads disposed on the interior surface, said writing instrument having circumferentially disposed threads removably receiving said closure member threads, a tubular reservoir containing opaque correction fluid open at one end and removably received and carried within the hollow cylindrical portion at said opposed end of said instrument, said tubular reservoir comprising an elongated tubular portion open at one end adapted to be frictionally and slidably received within the hollow cylindrical portion of said instrument, a circumferential flange surrounding said open end and extending radially therefrom to rest on the top surface of the hollow cylindrical portion of said instrument, a second closure member removably received on said instrument at said opposed end to sealably enclose the open end of said reservoir and comprising a cylindrical cap enclosed at one end and having threads disposed on the interior surface thereof, said writing instrument having circumferentially disposed threads adapted to engage the threads of said second closure member and upon turning said second closure member on said instrument said enclosed end sealably enclosing the open end of said reservoir, and a fluid applicator secured to and carried by said second closure member comprising a tubular brush stem having bristles at the inner end thereof removably received within said reservoir in a stored position.

4. A writing instrument according to claim 3 in which said second closure member has an external clip fastener adapted to be received on the pocket of the user for carrying said writing instrument therein with said reservoir in an upright position to prevent accidental loss of fluid from said reservoir.

* * * * *